US007841857B2

(12) United States Patent
Viggiani

(10) Patent No.: US 7,841,857 B2
(45) **Date of Patent: *Nov. 30, 2010**

(54) CANDLE HOLDER WITH SELF-EXTINGUISHING FLAME DEVICE

(75) Inventor: Anthony Viggiani, Swranches, FL (US)

(73) Assignee: Eclipse Home Decor, LLC, Delray Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/383,881

(22) Filed: Mar. 30, 2009

(65) Prior Publication Data

US 2009/0280446 A1 Nov. 12, 2009

Related U.S. Application Data

(63) Continuation-in-part of application No. 11/472,491, filed on Jun. 21, 2006, now Pat. No. 7,527,494.

(51) Int. Cl.
*F23N 5/00* (2006.01)

(52) U.S. Cl. ..... 431/35; 431/292; 431/290; 431/294; 431/296

(58) Field of Classification Search ..... 431/35, 431/290, 292, 296, 289, 294; D26/6
See application file for complete search history.

(56) References Cited

U.S. PATENT DOCUMENTS

| | | | | |
|---|---|---|---|---|
| 117,763 | A | 8/1871 | Fritsch | |
| 126,765 | A | 5/1872 | William | |
| 141,066 | A | 7/1873 | Morgan | |
| 434,298 | A | 8/1890 | Roell | |
| 952,935 | A | 3/1910 | Nott | |
| 2,213,203 | A | 9/1940 | Buchman | |
| D244,056 | S | 4/1977 | Jimenez et al. | |
| 6,152,728 | A | 11/2000 | Griffel | |
| 7,527,494 | B2 * | 5/2009 | Viggiani | 431/35 |

OTHER PUBLICATIONS

Clever Gear Catalog, Holiday 2005. See front cover and p. 2 (Rope candle).

* cited by examiner

*Primary Examiner*—Alfred Basichas
(74) *Attorney, Agent, or Firm*—Dan DeLa Rosa

(57) ABSTRACT

A self-extinguishing candle flame apparatus is provided, the apparatus comprises: a base; a post having opposing ends, at least a portion of the first end of the post is attached to the base; a pliable wax coil having opposing ends, at least a portion of the wax coil being situated upon the base, the wax coil forming a candle, the candle comprising an elongated wick being situated within the wax coil, at least a portion of the wick protruding from one end of the wax coil; and a self extinguishing device comprising at least two sections that form a clamp, at least a portion of each of the two sections being attached to a spring, each of the sections having opposing ends, the first end of each of the two sections comprises a head and the second end of each of the two sections comprises an arm, the first and second sections being connected at a joint, during a closed position, each of the heads contact one another and forms an extended rim with side walls and an aperture therebetween designed to receive a portion of the wax coil, the extended rim with the side walls forming a height that when the candle burns down within the aperture, the flame is extinguished by operation of oxygen deprivation.

20 Claims, 5 Drawing Sheets

CANDLE HOLDER WITH SELF-EXTINGUISHING FLAME DEVICE

RELATED APPLICATION

This application is a continuation-in-part of U.S. application Ser. No. 11/472,491, entitled "Candle Holder and Flame Extinguisher Device" which was filed on Jun. 21, 2006 now U.S. Pat. No. 7,527,494, which has now been granted a Notice of Allowance

BACKGROUND OF THE INVENTION

1. Field of the Invention

The present invention relates to a device for holding a candle that extinguishes a burning wick without mechanical or human interaction.

2. Description of the Related Art

Burning a candle presents an obviously safety hazard. Candles have an open flame burning from a wick and melted wax. The flame may overheat more wax than is needed to burn and cause the liquid hot wax to drip down from the top of the candle. If the dripping wax caught fire or if the candle tipped over indoors, a potential house fire could result.

Technology to improve the utilitarian aspects of burning a candle include various devices for holding a candle and automatically extinguishing the flame using mechanical means. Some devices attempt to automatically regulate the burning of a candle by using clamps or sharp edges, combined a moving or spring-loaded mechanism to cut off the burning wick when the wax candle burns down to a pre-set level. Some may snuff out the candle from lowering a device onto the burning wick once the candle recedes to a certain height. These mechanisms control the wick of the candle by loading a candle into either a spring-activated slide that cuts off the burning wick when the candle wax recedes below the trigger and releases the spring or attempt to extinguish the flame by a cup or plate above the candle that lowers down to the wick as the wax of the candle melts and burns away. However, these types of devices are subject to numerous problems and problematic assumptions. Spring-loaded clamps are assumed to work but may or may not close and cut the wick properly. The candle may burn lop-sided that either holds the mechanism open too long for the cutting part to properly extinguish the flame or will not allow a device to lower adequately and snuff out the flame.

Other candle holders attempt to extinguish a candle flame passively without using mechanized or spring-loaded slides against extinguish the wick. However, the prior devices create a potential fire hazard by not providing a passive candle extinguisher that provides an adequate enclosure around a burning candle so when the candle burns down, the flame is deprived of oxygen and extinguishes.

What is needed is a simple and reliable holder for a candle that consistently and automatically extinguishes the flame reliance on moving parts of mechanical extinguisher devices. The holder should extinguish a candle flame passively by the candle burning down into an enclosure that then suffocates the flame due to lack of oxygen.

SUMMARY OF THE INVENTION

In one embodiment, the present invention provides for a candle holder that includes two-piece holding device that securely holds a cylindrically-shaped wax or similar candle. The two pieces are connected by a rod on a stand and by a spring that holds the two pieces together. A candle is held securely, yet allows a user to manually open the holder and to adjust the candle length held in the holder by freely passing it through a holed area without damaging the candle. The two parts of the holding device are rotated about a pin joint similar to a pair of tongs or scissors. The spring maintains pressure against each of the two parts of the holding device such that the device is normally closed. When the two tongs of the device are closed, each part forms half of a bowl section that catches dripping wax from the candle.

The embodiments of the present invention also regulate the burning of a candle using a passive extinguisher that requires no mechanical parts or human intervention. A hole in the holding device is formed in the bowl when the two movable parts are closed. Each movable part forms half of the bowl and therefore half of the hole. Underneath the holding device, when the clamp is oriented properly with the top, bowl-side facing away from the ground, the hole is formed out of a both halves of a cylindrical extension on each part of the holding device. The extension is formed as a nearly-straight hollow cylinder away from the device's bowl area. When the holding device is opened, the cylindrical extension halves open in two at which time they may be positioned on either side of a candle and then closed, thereby securing the candle inside the cylindrical extension. When the candle burns down inside extension, the lack of adequate oxygen in the enclosed space to fuel the burning wick causes the flame to extinguish.

In another embodiment, the present invention provides for a candlelight device with a self extinguishing device, and the apparatus comprises: a base; a pliable wax coil having opposing ends, at least a portion of the wax coil being situated upon the base, the wax coil forming a candle; an elongated wick being situated within the wax coil, at least a portion of the wick protruding from one end of the wax coil; and a self extinguishing device comprising at least two sections that form tongs, each of the sections having opposing ends, said first end of each of the two sections comprises a head and said second end of each of the two sections comprises an arm, the first and second sections being connected at a joint, each of the heads of the two sections comprises half of a bowl with an extended portion, during a closed position, each of the heads contact one another and forms a bowl with generally cylindrical extended portions and an aperture therebetween designed to receive a portion of the wax coil, the bowl with the cylindrical extended portions forming a height that when the candle burns down within the aperture, the flame is extinguished by operation of oxygen deprivation.

In yet another embodiment, the apparatus further comprises a spring having opposing ends, each of the opposing ends of the spring is attached to at least a portion of said first and second sections. In another embodiment, the top surface of the bowl in a closed position is generally concave.

In still another embodiment, at least a portion of each of the two ends of the spring is directly attached to a portion of each of the two arms. In still yet another embodiment, the arms are depressed toward one another to allow each of the heads to move away from one another during an open position.

In a further embodiment, at least a portion of the candle is inserted in between the first and second heads during the open position and at least a portion of the protruding wick is situated above the bowl.

In another further embodiment, the arms are released and at least a portion of the candle is secured within the heads during the closed position. In still a further embodiment, the apparatus further comprises a post having opposing ends, at least a portion of the first end of the post is attached to the base, at least a portion of the self extinguishing device is attached to the post.

In yet a further embodiment, the second end of the post comprises a threaded portion and a peripheral edge for receiving the self extinguishing device, and the post further comprises a cap adapted to be attached to the threaded portion of the second end of the post and secure the self extinguishing device.

In still yet a further embodiment, the apparatus further comprising a plurality of rods, at least one end of each of the rods are directly attached to the base, and the rods are designed to hold the wax coils.

In another embodiment, the present invention relates to a self extinguishing candlelight apparatus comprising: a base; a post having opposing ends, at least a portion of said first end of the post is attached to the base; and a self extinguishing device comprising at least two sections that form clamp, each of the sections having opposing ends, said first end of each of the two sections comprises a head and said second end of each of the two sections comprises an arm, said first and second sections being connected at a joint, each of the heads of the two sections comprises half of an extended lip with an extended portion extending downwardly from the lip, during a closed position, each of the heads contact one another forming an aperture therebetween designed to receive a portion of a candle, and the head forms a height that when the candle burns down within the aperture, the flame is extinguished by operation of oxygen deprivation, at least a portion of the self extinguishing device is attached to the post.

In yet another embodiment, the apparatus further comprises a pliable wax coil having opposing ends, at least a portion of the wax coil is situated upon the base, and the wax coil forming the candle. In still another embodiment, the candle comprises an elongated wick being situated within the wax coil, at least a portion of the wick protruding from one end of said wax coil.

In a further embodiment, the second end of the post comprises a threaded portion and a peripheral edge for receiving the self extinguishing device, and the post further comprises a cap adapted to be attached to the threaded portion of the second end of the post and secure the self extinguishing device.

In another further embodiment, the apparatus further comprises a plurality of rods, at least one end of each of the rods being directly attached to the base, and the rods are designed to hold the wax coils.

In still another further embodiment, the present invention relates to a candlelight device with a self-extinguishing flame device, and the apparatus comprises: a base; a post having opposing ends, at least a portion of the first end of the post is attached to the base; a pliable wax coil having opposing ends, at least a portion of the wax coil being situated upon the base, the wax coil forming a candle, the candle comprising an elongated wick being situated within the wax coil, at least a portion of the wick protruding from one end of the wax coil; and a self extinguishing device comprising at least two sections that form a clamp, at least a portion of each of the two sections being attached to a spring, each of the sections having opposing ends, the first end of each of the two sections comprises a head and the second end of each of the two sections comprises an arm, the first and second sections being connected at a joint, during a closed position, each of the heads contact one another and forms an extended rim with side walls and an aperture therebetween designed to receive a portion of the wax coil, the extended rim with the side walls forming a height that when the candle burns down within the aperture, the flame is extinguished by operation of oxygen deprivation.

In another embodiment, the second end of the post comprises a threaded portion and a peripheral edge for receiving the self extinguishing device, the post further comprising a cap adapted to be attached to the threaded portion of the second end of the post and secure the self extinguishing device, the apparatus further comprising at least one rod, at least one end of the rod being directly attached to the base, the rod designed to hold the wax coils.

In a further embodiment, the head of the self extinguishing device has a bottom surface and the each of the two sections have opposing bottom ends, each end has a L-shaped end so that when the two sections are in a closed positions, the opposing L-shaped ends form a tight seal within the aperture of the extended rim and side walls.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessary to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
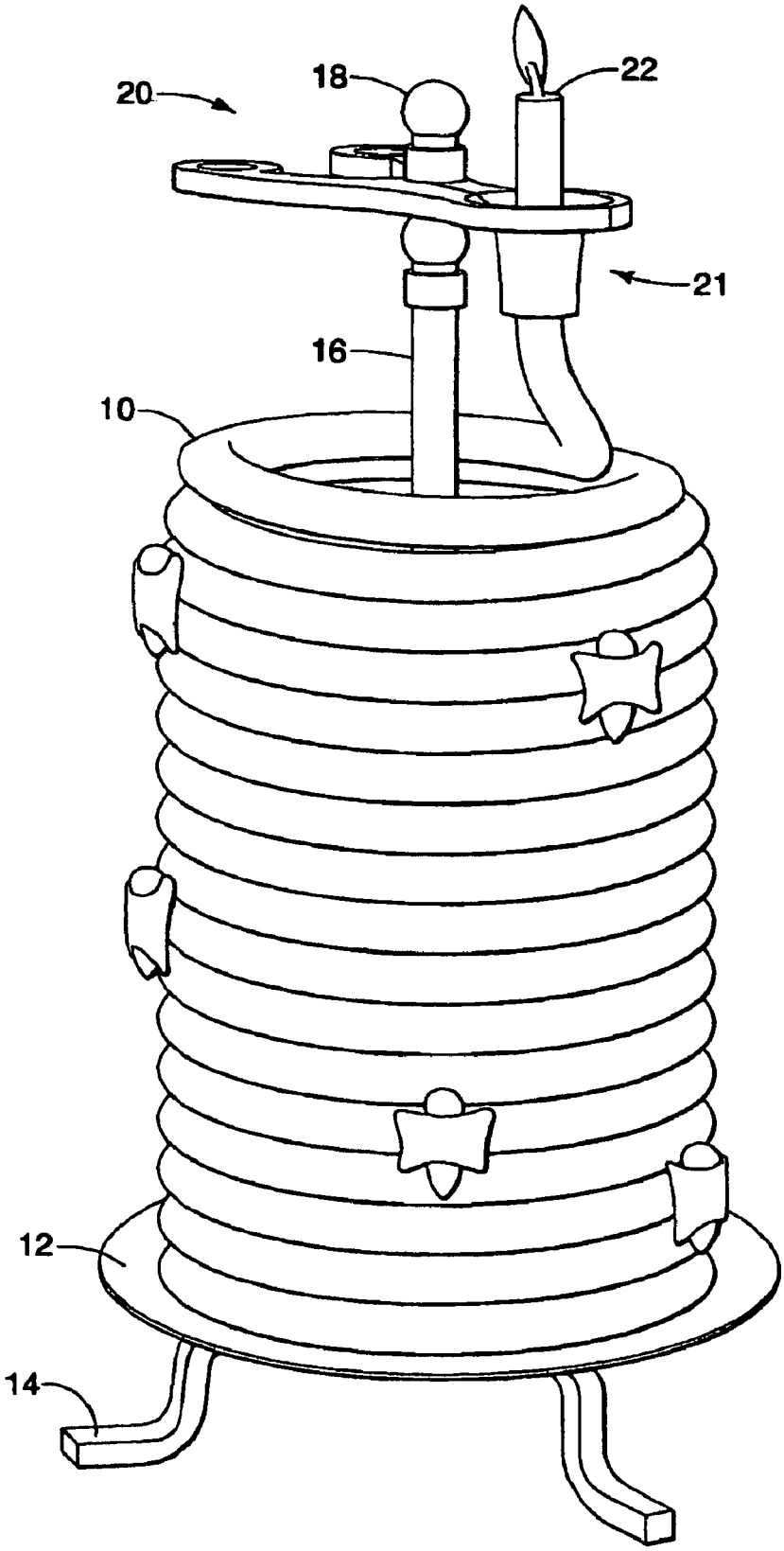
FIG. 1 is a diagram of the preferred embodiment for a candle holder with a candle that are both mounted on a stand.

Referring to FIG. 1, one of the embodiments of a candle holder 20 with a passive flame extinguisher is illustrated while mounted on a stand. A candle 10 is coiled upon a base 12 that is elevated from a surface by a plurality of legs 14 attached to the base 12. A rod 16 is attached to base 12 and rises vertically such that it remains in-place with adequate rigidity and strength to support holder 20. Candle 10 is cylindrically shaped but flexible to allow it to coil around rod 16 and stack up vertically upon itself. Candle holder device 20 is attached to rod 16, near the end distal to base 12, and held in place by cap 18. Candle holder 20 is preferably attached so that it is supported underneath the holder on the rod, to prevent the holder 20 from dropping down the rod, and allows holder 20 to support and end of candle 10. The holder 20 should swivel around rod 16 to provide rotational adjustment when drawing candle 10 up from the base 12.

Figure 2:
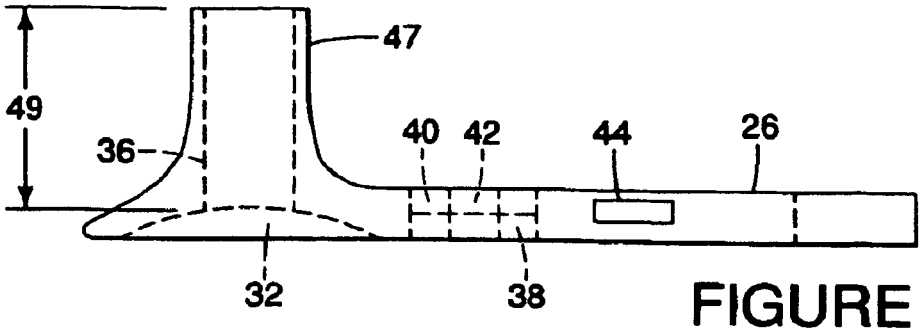
FIG. 2 is a side elevation diagram of the one part of the preferred embodiment for a candle holder.
Figure 3:
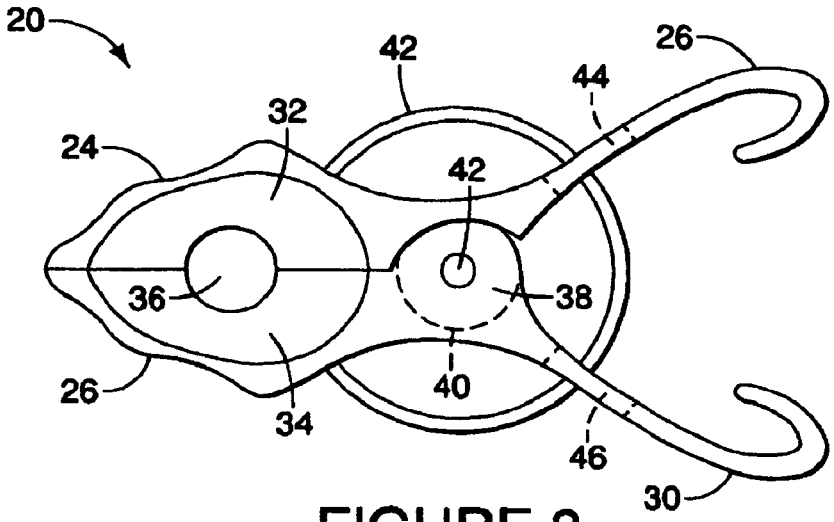
FIG. 3 is a plan elevation diagram of the combined parts for the preferred embodiment for a candle holder.

FIG. 3 shows an elevation plan of exemplary candle holder device 20 constructed as a clip comprises of two halves, or tongs, the first tong comprising a first head part 24 connected to arm 26 and the second tong comprising a head part 28 connected to arm 30. Both parts 24 and 28 are slidably assembled by rotational joints 38 for part 28 that slides over rotational joint 40 of part 24. When aligned, both joint parts create hole 42 that receives mounting rod 16. This is further illustrated in elevation plan views in FIGS. 2 and 4. Joint 40 slides underneath joint 38 to create a rotational joint of clip 20 that is mountable to rod 16. Part 24 and part 28 are held together in a normally closed position by spring element 42 that is a single semi-circular wire applying tension against each of parts 24 and 28. One end of spring 42 is secured to part 24. It then passes freely through arm 26 at opening 44 and passes freely through arm 30 at opening 46 after which it attaches part 28 as shown in the FIG. 3. Arm openings 44 and 46 form rectangular openings that allow the element 42 to move back and forth when the clip 20 is manually opened by squeezing arms 26 and 30 together.

In order to catch wax dripping from a candle, the head of each of the tongs forming the holding device 20 forms a bowl. Part 24 is formed with a semi-circular bowled part 32 that combines with the semi-circular bowled part 34 of head part 28. When held together with spring 42, the two parts 32 and 34 come together to form a bowl. In profile view of FIG. 4, the base edge of bowl 34 is shown in hidden lines and in FIG. 2, the base edge of bowl 32 is shown with hidden lines. Bowl parts 32 and 34 each have a semi-circular area cutout at the bottom of the bowl so that when the two head parts are closed together, a hole 36 is formed that can receive and hold a candle.

Figure 4:
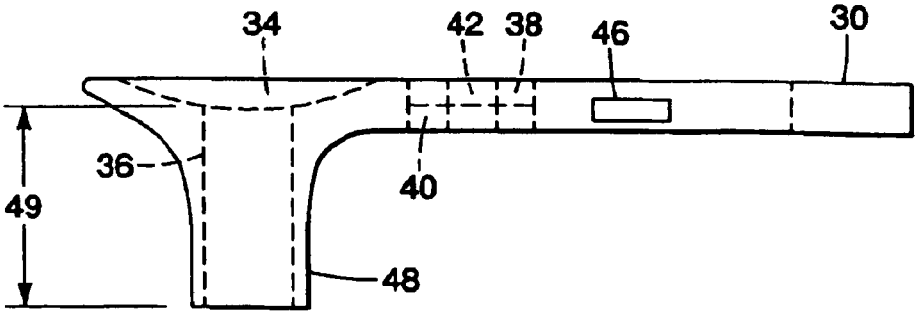
FIG. 4 is a side elevation diagram of one part of the preferred embodiment for a candle holder.

Under the device 20, each head part forms one-half of a cylindrical extension that forms the hole 36. FIG. 4 illustrates the side view of part 28, where the half cylindrical extension 48 extends in a taper away from bowl part 34. Hole diameter 36 is shown with hidden lines. FIG. 2 illustrates an inverted side elevation of part 24 and arm 26. Part 24 has cylindrical extension half 47 extending away from bowl 32. When extension members 47 and 48 are brought together by closing parts 24 and 28, a cylindrical extension 21 is formed creating hole 36 from its hollow interior that can receive and securely clamp a candle. This is shown in FIG. 1.

A burning candle placed in extension 21 will eventually recede in length to a point where the wick is burning from inside of the extension 21. FIG. 1 illustrates a portion of candle 10 held securely in the cylindrical member 21, which is formed by each part 47 and 48 clamping together around the candle 10. Addition lengths of candle 10 may be subsequently drawn through extension 21 by squeezing arms 26 and 30 together manually, thereby opening the head parts 24 and 28, and pulling a portion of coiled candle 10 to an upright position. A portion of candle 10 is positioned between cylindrical extension halves 47 and 48 and the handles 26 and 30 released. Extension halves 47 and 48 close on opposite sides of a candle portion and thereby secure the candle in holding device 20.

After the wick of candle 10 is lit, the portion of candle 10 held by holder 20 will burn down into the cylindrical member 21. Hot wax dripping from the candle will collect in the bowl area formed by parts 32 and 34 around the candle portion. After burning down the exposed portion of coiled candle 10 into cylindrical member 21, the flame will experience oxygen deprivation and extinguish itself. Cylindrical extension member 21 must extend an adequate length 49 from bowl parts 32, 34 so that when a candle burns down into the interior of the cylinder, the flame experiences oxygen depravation and extinguishes passively. Extinguishing therefore occurs without any further mechanism or manual interaction.

An important aspect of cylindrical extension member 21 is the length of the formed cylinder 49 extending from bowl parts 32 and 34. If the extension 21 has a length 49 that is too short, then a candle flame will not experience adequate oxygen deprivation to extinguish thereby defeating the purpose of a passive flame extinguisher. For example, candle holders in the prior art have used extensions of approximately one-quarter inch or less, which is an inadequate length to extinguish a typical candle safely. Lengths of greater than ¼ inch of extensions for the preferred and alternative embodiments provide consistent extinguishing of a candle that has a ⅜ inch diameter that is held in a ⅜ diameter hole 80. Thus, an extension length 89 that is at least as long as the diameter of hole 80 is a proper ratio for safely extinguishing flames of a burning candle held by the device. An extension length approximately twice the length of cylindrical extension diameter also provides passive flame extinguishing for the devices of the preferred and alternative embodiments. For example, an extension member 21 with a 5⁄16 inch diameter candle in hole 36 would cause a normal candle flame to consistently extinguish in a cylindrical member 21 with length 13⁄16 inches long 49. Exact lengths of extension 21 can vary according to the type of candle wax used in a candle for the present device and a type of wick. Generally, a length 49 of approximately a quarter-inch or less was found not to consistently extinguish a burning candle flame passively and therefore created a risk of burning through the holder 20 creating a fire hazard.

Figure 5:
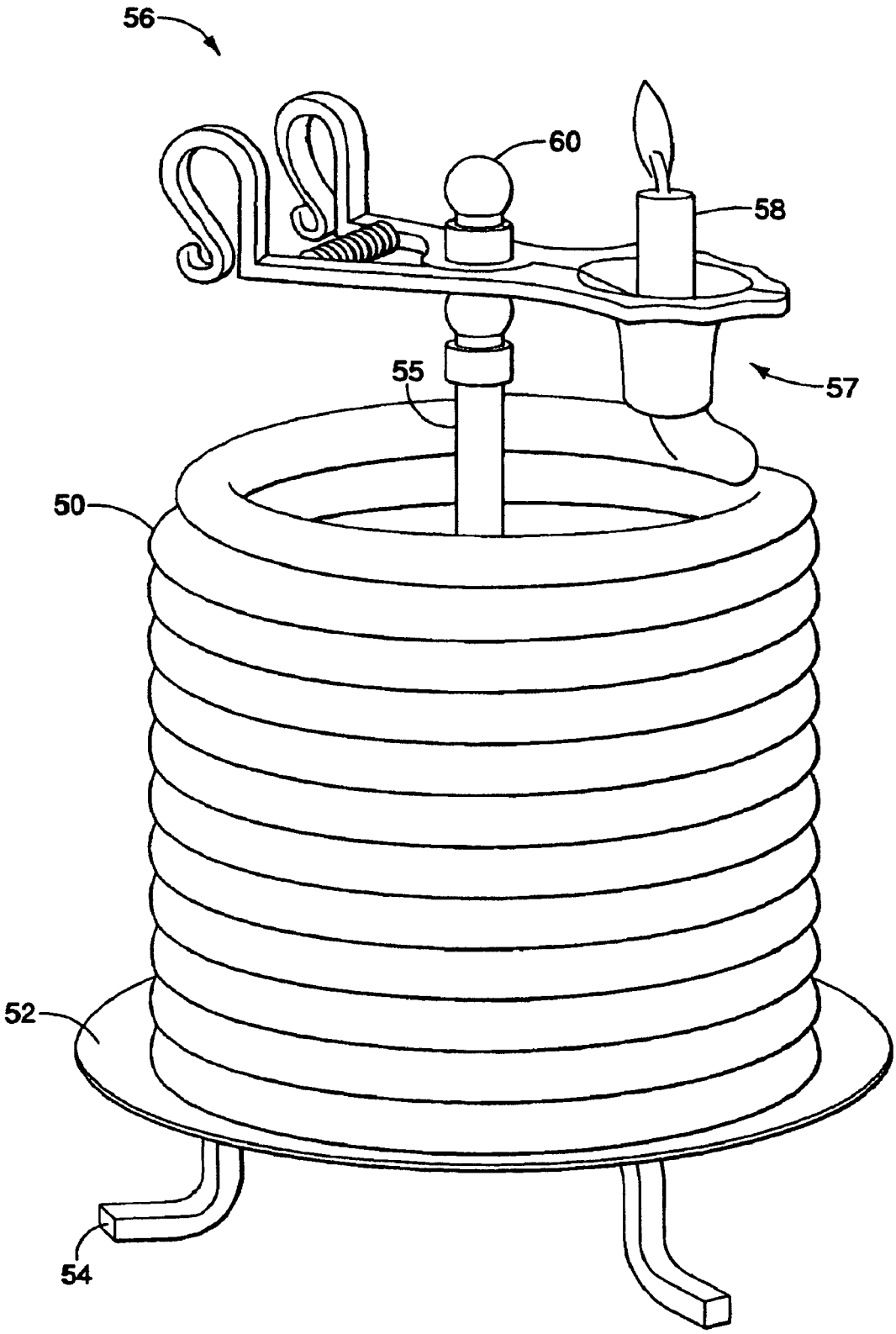
FIG. 5 is a diagram of an alternative embodiment for a candle holder with a candle that are both mounted on a stand.

Referring to FIG. 5, an alternative embodiment of a candle holder 56 with a passive flame extinguisher is illustrated while mounted on a stand. A candle 50 is coiled upon a base 52 that is elevated from a surface by a plurality of legs 54 attached to the base 52. A mounting rod 55 is attached to base 52 and rises vertically such that it remains in-place with adequate rigidity and strength to support holder 56. Candle 50 is cylindrically shaped but flexible to allow it to coil around rod 55 and stack up vertically upon itself. Candle holder device 56 is attached to rod 55, near the end distal to base 52, and held in place by cap 60. Candle holder 56 is preferably attached so that it is supported underneath the holder on the rod 55, to prevent the holder device from dropping down the rod, and allows holder 56 to support and end of candle 58. The holder 56 should swivel around rod 55 to provide rotational adjustment when drawing candle 50 up from the base 52.

Figure 6:
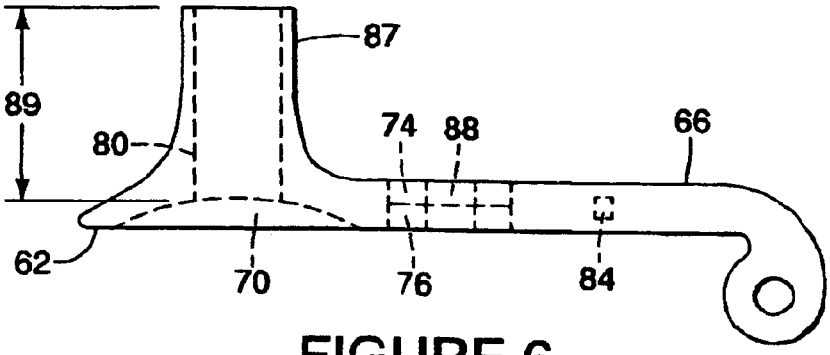
FIG. 6 is a side elevation diagram of the one part of the alternative embodiment for a candle holder.
Figure 7:
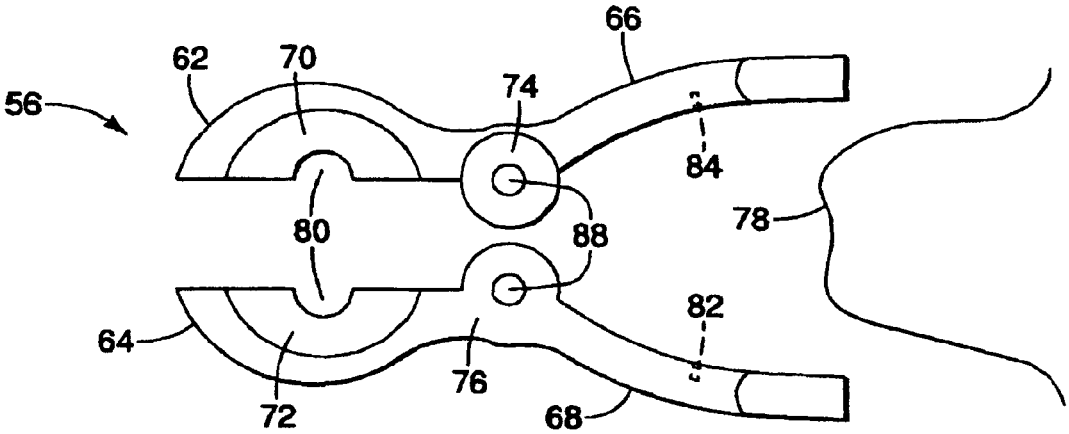
FIG. 7 is a plan elevation diagram of the combined parts for the alternative embodiment for a candle holder.

FIG. 7 shows an elevation plan of exemplary candle holder device 56 constructed as a clip comprises of two halves, or tongs, the first tong comprising a first head part 62 connected to arm 66 and the second tong comprising a head part 64 connected to arm 82. Both parts 62 and 64 are slidably assembled by rotational joints 76 for part 64 that slides over rotational joint 74 of part 62. When aligned, both joint parts create hole 88 that receives mounting rod 55. This is further illustrated in elevation plan views in FIGS. 6 and 8. Joint 74 slides underneath joint 76 to create a rotational joint of clip 56 that is mountable to rod 55.

Head parts 62 and 64 are held together in a normally closed position by spring element 78 that is preferably a bent U-shaped wire applying a biased force against each of the handle arms 84 and 82. One end of spring 78 is inserted into arm 77 at indent 84 and the opposite end is inserted into arm 68 at indent 82. Arm indents 82 and 84 form openings that allow the spring 78 to move when the clip 56 is manually opened by squeezing arms 66 and 82 together.

In order to catch wax dripping from a candle, the head of each of the tongs forming the holding device 56 forms a bowl. Head part 62 is formed with a semi-circular bowled part 70 that combines with the semi-circular bowled part 72 of head part 64. When held together with spring 78, the two parts 62 and 64 come together to form a bowl. In profile view of FIG. 8, the base edge of bowl 72 is shown in hidden lines and in FIG. 6, the base edge of bowl 70 is shown with hidden lines. Bowl parts 70 and 72 each have a semi-circular area cutout at the bottom of the bowl so that when the two head parts are closed together, a hole 80 is formed that can receive and hold a candle portion 58.

Figure 8:
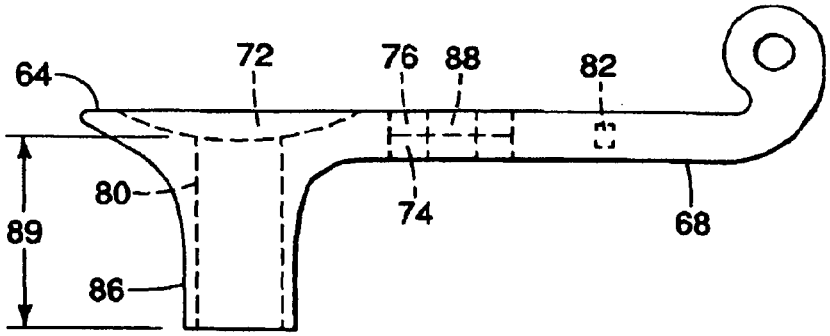
FIG. 8 is a side elevation diagram of one part of the alternative embodiment for a candle holder.

Each head part forms one-half of a cylindrical extension 57 that extends from under the device 56 and forms the hole 36. FIG. 8 illustrates the side view of part 64, where the half cylindrical extension 86 extends in a taper away from bowl part 72. Hole diameter 80 is shown with hidden lines. FIG. 6 illustrates an inverted side elevation of the other tong comprising head part 62 and arm 66. Part 62 has cylindrical extension half 87 extending away from bowl 70. When extension members 86 and 87 are brought together by closing parts 62 and 64, a cylindrical extension 57 is formed, thereby creating hole 80 from its hollow interior that can receive and securely clamp a candle 58. This is shown in FIG. 5.

A burning candle placed in extension 57 will eventually recede in length to a point where the wick is burning from inside of the extension 57. FIG. 1 illustrates a portion 58 of candle 50 held securely in the cylindrical member 57, which is formed by each part 86 and 87 clamping together around the candle 50. Addition lengths of candle 50 may be subsequently drawn through extension 57 by squeezing arms 66 and 68 together manually, thereby opening the head parts 62 and 64, and pulling a portion of coiled candle 50 to an upright position. When a portion of candle 50 is positioned between cylindrical extension halves 86 and 87, the handle arms 66 and 68 are released. Extension halves 86 and 87 close on opposite sides of a candle portion and thereby secure the candle in holding device 56.

After the wick of candle 50 is lit, the portion 58 held by holder 56 will burn down into the cylindrical member 57. Hot wax dripping from the candle will collect in the bowl area formed by parts 70 and 72 around the candle portion. After burning down the exposed portion of coiled candle 50 into cylindrical member 57, the flame will experience oxygen deprivation and extinguish itself Cylindrical extension member 57 must extend an adequate length 89 from bowl parts 70 and 72 so that when a candle burns down into the interior of the cylinder 57, the flame fully extinguishes. Extinguishing therefore occurs without any further mechanism or manual interaction.

An important aspect of cylindrical extension member 57 is the extending length 89 as shown in FIGS. 6 and 8. If the extension 57 has a length 99 that is too short, then a candle flame will not experience adequate oxygen deprivation to extinguish, thereby defeating the purpose of a passive flame extinguisher. For example, candle holders in the prior art have used extensions of approximately one-quarter inch or less, which is an inadequate length to extinguish a typical candle safely. Lengths of greater than ¼ inch of extensions for the preferred and alternative embodiments provide consistent extinguishing of a candle that has a ⅜ inch diameter that is held in a ⅜ diameter hole 80. Thus, an extension length 89 that is at least as long as the diameter of hole 80 is a proper ratio for safely extinguishing flames of a burning candle held by the device. For example, an extension member 57 with a 5⁄16 inch diameter hole 80 would also allow an average candle flame from a 5⁄16 inch candle to consistently extinguish in a cylindrical member 57 with a length of 13⁄16 inches.

Figure 9:
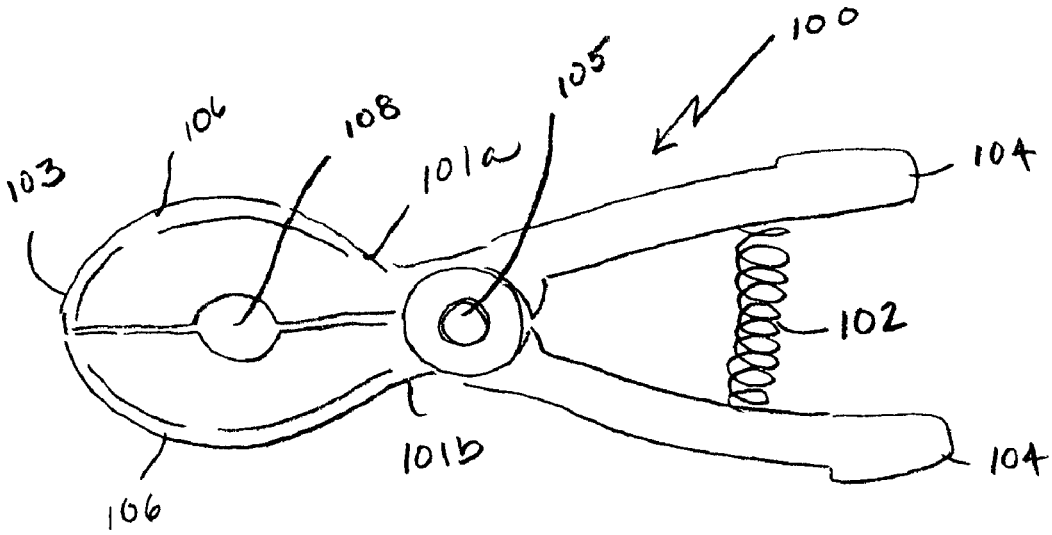
FIG. 9 shows an overhead view of one embodiment of the self extinguishing device of the present invention.
Figure 10:
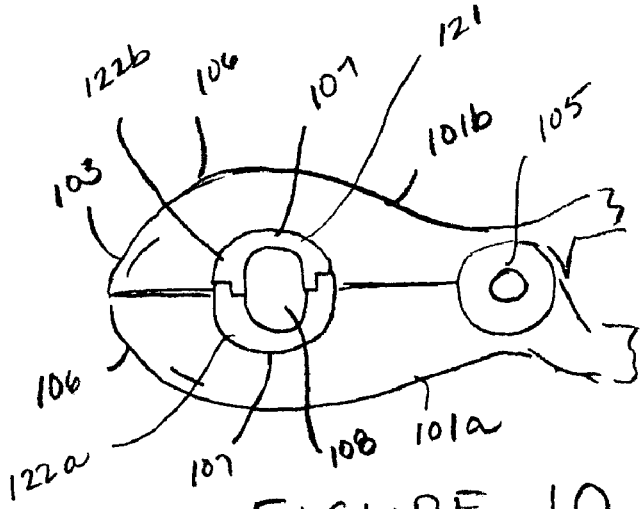
FIG. 10 is a bottom view of the head of the self extinguishing device.

FIGS. 9 and 10 depict another embodiment of the self-extinguishing flame device 100 of the present. The device 100 comprises at least two sections, 101*a* and 101*b* respectively, that form a clamp, at least a portion of each of the two sections being attached to a spring 102, each of the sections having opposing ends, the first end of each of the two sections, 101*a* and 101*b* respectively, comprises a head 103 and the second end of each of the two sections comprises an arm 104, the first and second sections, 101*a* and 101*b* respectively, being connected at a joint 105. During a closed position, each of the heads 103 contact one another and forms an extended rim 106 with side walls 107 and an aperture 108 therebetween designed to receive a portion of the wax coil (not shown), and the extended rim 106 with the side walls 107 forming a height that when the candle burns down within the aperture 108, the flame is extinguished by operation of oxygen deprivation. In FIG. 10, the head 103 of the self extinguishing device 100 has a bottom surface 121 and the each of the two sections, 101*a* and 101*b* respectively, have opposing bottom ends, 122*a* and 122*b*, each end has a L-shaped end so that when the two sections are in a closed positions, the opposing L-shaped ends form a tight seal within the aperture 108 of the extended rim 106 and side walls 107.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A candlelight device with a self extinguishing device, said apparatus comprising:

a base;

a pliable wax coil having opposing ends, at least a portion of said wax coil being situated upon said base, said wax coil forming a candle;

an elongated wick being situated within said wax coil, at least a portion of said wick protruding from one end of said wax coil; and a self extinguishing device comprising at least two sections that form tongs, each of said sections having opposing ends, said first end of each of said two sections comprises a head and said second end of each of said two sections comprises an arm, said first and second sections being connected at a joint, each of said heads of said two sections comprises half of a bowl with an extended portion, during a closed position, each of said heads contact one another and forms a bowl with generally cylindrical extended portions and an aperture therebetween designed to receive a portion of said wax coil, said bowl with said cylindrical extended portions forming a height that when said candle burns down within said aperture, the flame is extinguished by operation of oxygen deprivation.

2. The apparatus of claim 1 further comprising a spring having opposing ends, each of said opposing ends of said spring being attached to at least a portion of said first and second sections.

3. The apparatus of claim 2 wherein at least a portion of each of said two ends of said spring is directly attached to a portion of each of the two arms.

4. The apparatus of claim 1 wherein said arms are depressed toward one another to allow each of said heads to move away from one another during an open position.

5. The apparatus of claim 4 wherein at least a portion of said candle is inserted in between said first and second heads during said open position and at least a portion of said protruding wick is situated above said bowl.

6. The apparatus of claim 5 wherein said arms are released and at least a portion of said candle is secured within said heads during said closed position.

7. The apparatus of claim 1 further comprising a post having opposing ends, at least a portion of said first end of said post is attached to said base, at least a portion of said self extinguishing device is attached to said post.

8. The apparatus of claim 7 wherein said second end of said post comprises a threaded portion and a peripheral edge for receiving said self extinguishing device, said post further comprising a cap adapted to be attached to said threaded portion of said second end of said post and secure said self extinguishing device.

9. The apparatus of claim 1 further comprising a plurality of rods, at least one end of each of said rods being directly attached to said base, said rods designed to hold said wax coils.

10. A self extinguishing candlelight apparatus comprising:

a base;

a post having opposing ends, at least a portion of said first end of said post is attached to said base; and a self extinguishing device comprising at least two sections that form clamp, each of said sections having opposing ends, said first end of each of said two sections comprises a head and said second end of each of said two sections comprises an arm, said first and second sections being connected at a joint, each of said heads of said two sections comprises half of an extended lip with an extended portion extending downwardly from said lip, during a closed position, each of said heads contact one another forming an aperture therebetween designed to receive a portion of a candle, said head forms a height that when said candle burns down within said aperture, the flame is extinguished by operation of oxygen deprivation, at least a portion of said self extinguishing device is attached to said post.

11. The apparatus of claim 10 further comprising a spring having opposing ends, each of said opposing ends of said spring being attached to at least a portion of said first and second sections.

12. The apparatus of claim 11 wherein at least a portion of each of said two ends of said spring is directly attached to a portion of each of the two arms.

13. The apparatus of claim 10 wherein said arms are depressed toward one another to allow each of said heads to move away from one another during an open position.

14. The apparatus of claim 13 wherein at least a portion of the candle is inserted in between said first and second heads during said open position and at least a portion of said protruding wick is situated above said bowl.

15. The apparatus of claim 10 further comprising a pliable wax coil having opposing ends, at least a portion of said wax coil being situated upon said base, said wax coil forming said candle.

16. The apparatus of claim 15 wherein said candle comprises an elongated wick being situated within said wax coil, at least a portion of said wick protruding from one end of said wax coil.

17. The apparatus of claim 10 wherein said second end of said post comprises a threaded portion and a peripheral edge for receiving said self extinguishing device, said post further comprising a cap adapted to be attached to said threaded portion of said second end of said post and secure said self extinguishing device.

18. The apparatus of claim 10 further comprising a plurality of rods, at least one end of each of said rods being directly attached to said base, said rods designed to hold said wax coils.

19. A candlelight device with a self extinguishing device, said apparatus comprising:

a base;

a post having opposing ends, at least a portion of said first end of said post is attached to said base;

a pliable wax coil having opposing ends, at least a portion of said wax coil being situated upon said base, said wax coil forming a candle, said candle comprising an elongated wick being situated within said wax coil, at least a portion of said wick protruding from one end of said wax coil; and a self extinguishing device comprising at least two sections that form a clamp, at least a portion of each of said two sections being attached to a spring, each of said sections having opposing ends, said first end of each of said two sections comprises a head and said second end of each of said two sections comprises an arm, said first and second sections being connected at a joint, during a closed position, each of said heads contact one another and forms an extended rim with side walls and an aperture therebetween designed to receive a portion of said wax coil, said rim with said side walls forming a height that when said candle burns down within said aperture, the flame is extinguished by operation of oxygen deprivation.

20. The apparatus of claim 19 wherein said second end of said post comprises a threaded portion and a peripheral edge for receiving said self extinguishing device, said post further comprising a cap adapted to be attached to said threaded portion of said second end of said post and secure said self extinguishing device, said apparatus further comprising at least one rod, at least one end of said rod being directly attached to said base, said rod designed to hold said wax coils.

* * * * *